US008896465B2

(12) United States Patent
Raz et al.

(10) Patent No.: US 8,896,465 B2
(45) Date of Patent: Nov. 25, 2014

(54) METHOD AND DEVICE FOR PROVIDING ADVANCED INDICATIONS TO A VEHICLE'S DRIVER

(75) Inventors: Ofer Nissim Raz, Tel-Aviv (IL); Oren Musicant, Tel-Aviv (IL)

(73) Assignee: Greenroad Driving Technologies Ltd., Beit Dagan (IL)

( * ) Notice: Subject to any disclaimer, the term of this patent is extended or adjusted under 35 U.S.C. 154(b) by 290 days.

(21) Appl. No.: 13/438,779

(22) Filed: Apr. 3, 2012

(65) Prior Publication Data

US 2012/0280835 A1 Nov. 8, 2012

(30) Foreign Application Priority Data

May 6, 2011 (IL) ..... 213373

(51) Int. Cl.

| | |
|---|---|
| ***G08G 1/09*** | (2006.01) |
| ***G08G 1/0967*** | (2006.01) |
| ***G08G 1/01*** | (2006.01) |

(52) U.S. Cl.

CPC ..... *G08G 1/0112* (2013.01); *G08G 1/096741* (2013.01); *G08G 1/0141* (2013.01); *G08G 1/096716* (2013.01); *G08G 1/096775* (2013.01); *G08G 1/0129* (2013.01)

USPC ... 340/905; 340/426.1; 340/438; 340/539.13; 340/426.11

(58) Field of Classification Search

USPC ..... 315/291; 340/426.1, 905, 429.19, 438, 340/539.13, 426.11

See application file for complete search history.

(56) References Cited

U.S. PATENT DOCUMENTS

| | | | | |
|---|---|---|---|---|
| 3,775,743 | A | 11/1973 | Carter | |
| 5,913,917 | A | 6/1999 | Murphy | |
| 5,917,430 | A | 6/1999 | Greneker, III et al. | |
| 6,014,601 | A | 1/2000 | Gustafson | |
| 7,389,178 | B2 | 6/2008 | Raz et al. | |
| 8,519,836 | B2 * | 8/2013 | Grossman | 340/426.1 |
| 2003/0090392 | A1 | 5/2003 | Schuessler | |
| 2004/0093264 | A1 | 5/2004 | Shimizu | |
| 2005/0021222 | A1 | 1/2005 | Minami et al. | |
| 2007/0027593 | A1 | 2/2007 | Shah et al. | |
| 2007/0146162 | A1 * | 6/2007 | Tengler et al. | 340/905 |
| 2007/0247291 | A1 | 10/2007 | Masuda et al. | |
| 2008/0295586 | A1 | 12/2008 | Fosseen | |
| 2009/0002193 | A1 | 1/2009 | Cemper | |
| 2009/0146846 | A1 * | 6/2009 | Grossman | 340/988 |
| 2010/0090818 | A1 | 4/2010 | Sekiyama et al. | |
| 2010/0253491 | A1 * | 10/2010 | Grossman | 340/426.11 |

FOREIGN PATENT DOCUMENTS

| | | | |
|---|---|---|---|
| EP | 1 973 078 | A1 | 3/2007 |
| EP | 2 127 953 | A1 | 12/2007 |
| WO | WO 2009/125178 | A2 | 10/2009 |

* cited by examiner

*Primary Examiner* — Daryl Pope

(74) *Attorney, Agent, or Firm* — Dekel Patent Ltd.; David Klein

(57) ABSTRACT

A method is described for providing an advanced indication to a driver that a road segment which will require his attention is located along his route. The method comprising: a) detecting the vehicle's current location and identifying a road segment that the driver is about to reach; b) for the identified road segment, retrieving values of driving performance parameters associated therewith; c) evaluating whether any of the retrieved values exceeds a pre-defined threshold, and based on that evaluation, determining whether the identified road segment is a low service level segment and thus would require the driver's attention; and d) providing the driver with an advanced indication indicating the road segment which has been determined as being a segment of a low service level for the driver.

20 Claims, 3 Drawing Sheets

METHOD AND DEVICE FOR PROVIDING ADVANCED INDICATIONS TO A VEHICLE'S DRIVER

BENEFIT CLAIM

The present application claims the benefit and foreign priority under 35 U.S.C. 119 from Israel Patent Application No.: IL 213373, filed Jun. 5, 2011, the entire contents of which are hereby incorporated by reference for all purposes as if fully set forth herein.

TECHNICAL FIELD

The present invention relates to a method and system for reducing unsafe and/or non-economic driving behavior and in particular to a method and system to alert drivers who are about to reach hazardous road segments and/or may improve on their driving, economy-wise.

BACKGROUND OF THE DISCLOSURE

To a large extent, risks which drivers undertake while driving the vehicles and vehicles' fuel consumption, are attributed to a large extent to the drivers' performance which may be influenced by many factors, e.g. their experience (or to be more precise their lack of experience) or their physical current driving condition (tiredness, driving under influence of alcohol, etc.). When investigating every case on its merits, one may easily note that drivers are the crucial factor for a large number of the accidents. Nevertheless, it is a well-known fact that some roads are more dangerous than others due to various factors such as infrastructure, road design, road signs, weather, traffic density and the like. Other roads' characteristics attribute to high fuel consumption due to usual congestion conditions and other road design problems.

There are quite a few prior art publications that describe systems and methods for providing the drivers with alerts that relate to hazards that exist along the path they are driving.

U.S. Pat. No. 5,917,430 describes a system for transmitting messages, such as safety hazard warning messages, to be provided to drivers with message capable radar receivers. The signal is modulated in such a way that conventional radar detectors do not reject the signal but cause an alert to be generated, indicating to the driver the need to reduce vehicle speed to accommodate upcoming road conditions or obstacles.

U.S. Pat. No. 6,014,601 discloses a laser transmitter that is configured to transmit a laser beam at an object, and a laser receiver configured to receive a reflection of the laser beam. A speed sensor is connected to a vehicle speedometer system and receives vehicle speed information. A processing unit receives laser pulse data from the laser receiver and road condition data from a road condition switch, and the vehicle speed information from the speed sensor. The processing unit calculates a relative speed of the object with respect to the vehicle, a distance from the object to the vehicle, and a relative acceleration of the object with respect to the vehicle. The processing unit further calculates a safe following distance based on the road condition data and the vehicle speed information, and compares the safe following distance to the actual distance from the object to the vehicle. The processing unit further calculates a collision time based on the relative speed of the object, the distance from the object to the vehicle, and the relative acceleration of the object. The collision time is displayed on a collision time display. A linear light display indicates the relative level of safety or danger based on following distance and collision time.

US 2003090392 describes a device for issuing of a hazard warning to the driver of a motor vehicle with a data transmission device for transmitting and receiving data. The data transmission device exchanges data with data transmission devices of other vehicles and emitting data to warn other vehicles of hazards as well as evaluates the received data and outputting warning signals to the driver when a hazard is detected.

U.S. Pat. No. 3,775,743 discloses an automatic driver aid system for a vehicle which includes means to alert the driver of approaching conditions and regulations requiring his caution, such as stop signs, school caution zones, dangerous intersections, etc., and means to warn the driver upon violation of certain traffic regulations such as speed limits, emergencies, etc.

US 2009002193 describes devices and methods for alerting a driver that a potential hazard is in the vicinity of the driver's vehicle. In general, activation signals transmitted from a vehicle are received at a potential hazard, and hazard signals are, in response, transmitted from the potential hazard to the vehicle. The hazard signals provide an indication of the potential hazard to the driver so that he may be aware of the potential hazard and react accordingly. The hazard signals may also include one or more characteristics of the potential hazard to provide more information about the potential hazard to the driver, such as the type of potential hazard and/or the degree of danger associated with the potential hazard.

The above publications as well as others, aim to provide the driver with alerts that relate to known hazardous road conditions along the road which he/she is currently driving. However, these solutions are not sufficient, as none of the prior art publications offer adequate solutions that take into account that the service level as defined hereinafter. The solution provided by the present invention seeks to overcome this gap.

SUMMARY OF THE DISCLOSURE

It is an object of the present invention to provide a method and a device for providing a driver of a vehicle with an advanced warning, indicating that there is one or more hazardous road segments located ahead of the driver's current location.

It is another object of the present invention to provide a method and a device for providing a driver of a vehicle with an indication that he/she is about to meet certain road conditions which are likely to cause that he/she will drive his/her vehicle in a less economical manner.

It is another object of the present invention to provide a method and a device for warning a driver about coming dangerous driving situations based on his/her driving performance and identified hazards existing along the route that the driver is currently driving.

It is yet another object of the present invention to enable using real time information derived from a database, which is based on driving events that were experienced by a plurality of vehicles, in road segments located along the route taken by the driver.

It is still another object of the invention to provide the driver with personalized advanced warnings on expected hazards along his/her route based on his/her driving performance.

It is another object of the invention to provide the driver with personalized advanced warnings on a predicted decrease in fuel economy along one or more segments of his/her expected route, based on his/her driving performance and the route segment characteristics.

Other objects of the invention will become apparent as the description of the invention proceeds.

According to a first embodiment of the present invention there is provided a method for providing a driver of a vehicle with an advanced indication that one or more road segments which represent a low service level for the driver (e.g. and thus will require the driver's specific attention) are located along the driver's route, wherein the method comprising:

detecting the vehicle's current location and based on the detected location, identifying at least one road segment that the driver is about to reach;

for each of the at least one road segment identified, retrieving values of one or more driving performance parameters associated therewith;

evaluating whether any of the retrieved values of the one or more driving performance parameters exceeds a pre-defined threshold thereof, and based on that evaluation, determining whether any of the at least one road segment identified, might present a segment of a too low service level; and providing the driver with an advanced indication for any of the at least one road segment which has been determined as being a segment of a too low service level for the driver.

The term "service level" of a segment as used herein throughout the specification and claims is used to denote the level of safety and/or the level of economical driving, at which a driver would drive a given road segment. This service level does not depend only on obstacles existing along that road segment, but is also dependent upon various other factors such as drivers' experience, bad design of the road segment, improper signs, poor visibility, and the like. The service level of a road segment can be different for each driver, as it preferably depends upon the driver's own driving performance while carrying out the events and/or maneuvers that should be carried out while driving the specific or similar road segments (e.g. curves that are known to exist in that road segment). For such cases, a road segment may be determined as being a hazardous road segment if it is associated with a low service level calculated for a specific driver driving that road segment. Also, throughout the specification and claims both terms "hazardous" and "service level" are applied when relating to non-safe road segments. Both terms should be understood to be interchangeable having essentially the same meaning The indication (e.g. the warning) provided to the driver is intended to draw his/her attention to a certain road segment which his/her vehicle is about to reach, and wherein this road segment comprises some difficulties to that specific driver, and therefore has been established as a road segment with too low service level for that driver. The indication which according to this embodiment is generated after analyzing the driver's own driving performance, may be used to alert the driver that given his/her driving performance, the road segment which he/she is about to reach comprises obstacles that may present hazards to him/her. In addition or in the alternative, the indication which, as stated before, is preferably generated after analyzing the driver's own driving performance, may be used for alerting the driver that given his driving performance with respect to fuel consumption, the road segment which he is about to reach comprises obstacles that might lead to a decrease in his fuel consumption performance.

In accordance with another embodiment, the one or more driving performance parameters are parameters that reflect the driving performance of the driver. More preferably, at least one of the one or more driving performance parameters is a parameter that reflects the driver's past performance of at least one driving event and/or at least one driving maneuver.

According to another embodiment, the values of the one or more driving performance parameters associated with a respective road segment are derived by: a) averaging performance results of a plurality of drivers who drove that specific road segment (e.g. fuel consumption), or b) evaluating potential difficulties associated with that specific road segment (e.g. curves, poor visibility (whether due to weather or night conditions or due to physical obstacles along that segment)) which might result in that the specific road segment is of a low service level for the driver and comparing them with the driver's own driving history performance while confronting such difficulties, or c) any combinations of a) and b).

According to another embodiment, the one or more driving performance parameters are maneuvers taken by the driver while driving under certain conditions which exist in the at least one road segment identified, e.g. taking a turn on the road.

In accordance with another embodiment, step c comprises:

comparing the values of driving performance parameters which characterize the driver's driving performance with pre-defined threshold values of corresponding driving performance parameters associated with the at least one road segment; and determining based on that comparison whether the indication should be provided to the driver.

As will be appreciated by those skilled in the art, the pre-defined threshold value of the driving performance parameters may be defined as being dependent on other parameters. For example, if the parameter is the driving speed while passing a vehicle, a pre-defined threshold value may be different for driving between 06:00 and 18:00 (day time) and between 16:00 to 06:00 (night time). In addition, a pre-defined threshold value of a driving parameter may be defined as being "higher or lower than . . . ", e.g. lower than 15 MPH or higher than 80 MPH.

Thus, while implementing an embodiment of the invention, some of the drivers may be provided with an advanced indication/warning when they approach a certain road segment while others will not, depending on the drivers' own individual driving performance.

It should be noted that the determination whether the indication should be provided may be associated with one or more individual driving performance parameters, wherein if the value of any of these individual driving performance parameters exceeds the pre-defined threshold for that certain road segment, the indication associated with a low service level of that certain road segment (and thus is intended to draw the driver's attention), will be provided. In addition or in the alternative, the determination is based upon the value of a combination of values of a number of such individual driving performance parameters, and the criterion for providing the indication/warning is met when the value of that combination exceeds the combined value of all the corresponding pre-defined threshold values of these driving performance parameters.

In accordance with another embodiment the method further comprises a step of monitoring the driver's current driving performance, and wherein the step of determining whether an advanced indication should be provided for any of the at least one road segment identified, is further based upon the driver's current driving performance.

According to another embodiment, the method provided further comprising:

(i) a step of monitoring the driver's performance during a period of time the precedes the provisioning of the advanced indication/warning;

(ii) based on the monitoring step, obtaining a grade for each of a plurality of driving maneuvers taken by the driver; and (iii) deriving values for at least one of the one or more driving parameters that characterizes the driver's performance, based on the step of grading each of a plurality of driving maneuvers taken by the driver.

Preferably, a driving performance parameter is a member of a group consisting of: speed, acceleration, execution level of specified maneuvers, safety in executing specified maneuvers, time of the day, and the like.

According to another aspect, there is provided a device adapted to be installed in a vehicle and to provide the driver of the vehicle with an advanced indication/warning, that one or more road segments are identified as low service level segments (and as such may require the driver's specific attention, e.g. hazardous road segment, a segment that includes certain physical conditions which will adversely affect the fuel consumption of a vehicle being driven by that driver, etc.) are located along the driver's route, wherein the device comprises:

location means operative to detect the vehicle's current location (e.g. a GPS detector);

transceiver operative to communicate with a remote system and to:

provide the remote system with information that relates to the vehicle current location; and receive values of one or more driving performance parameters associated with at least one road segment that is located along the vehicle's route;

processor operative to:

evaluate whether any of the received values of the one or more driving performance parameters exceeds a pre-defined threshold thereof; and based on that evaluation, determine whether any of the at least one road segment located along the vehicle route is a low service level segment for the driver; and indication provisioning means operative to provide the driver with an advanced indication/warning for any of the at least one road segment which has been determined as a segment of low service level.

In accordance with another preferred embodiment, the one or more driving performance parameters are parameters that reflect the driving performance of the driver. More preferably, at least one of the one or more driving performance parameters is a parameter that reflects the driver's past performance of at least one driving event and/or at least one driving maneuver.

According to another preferred embodiment of the invention the values of the one or more driving performance parameters associated with a respective road segment are derived by: a) averaging performance results associated with a plurality of drivers who had driven that specific road segment, or b) evaluating physical conditions associated with that specific road segment (e.g. curves, poor visibility (whether due to weather or night conditions or due to physical obstacles along that segment)) that might affect the service level of that segment and correlating them with the driver's own history performance while confronting such physical conditions, or c) any combination of a) and b).

According to another embodiment, the one or more driving performance parameters are maneuvers taken by the driver while driving under certain road conditions which exist in the at least one road segment identified, e.g. taking a sharp turn on the road.

In accordance with another embodiment, the processor is further operative to:

compare the values of driving performance parameters which characterize the driver's driving performance with predefined threshold values of corresponding driving performance parameters associated with the at least one road segment; and determine based on that comparison whether the indication should be provided.

According to another embodiment, the device provided further comprises monitoring means operative to monitor the driver's performance during a period of time that precedes the provisioning of the advanced warning/indication, and wherein the processor is further operative to grade each of a plurality of driving maneuvers taken by the driver based on information received from the monitoring means and to associate values for at least one of the one or more driving parameters that characterizes the driver's own performance, based on the grades assigned for each of a plurality of driving maneuvers taken by the driver.

The advanced indications/warnings provided are personalized advanced indications/warnings and the device is operative to generate these indications/warnings based upon the driver's own driving performance, whether during the current driving session or based on the driver's logged driving history.

In accordance with yet another embodiment, the advanced indication/warning comprises information to enable (or to recommend to) the specific driver how to overcome an obstacle that has been identified as one that would have a potential adverse effect upon the safety and/or the economical driving of the driver (i.e. that would lower the road segment's service level for the driver) while driving the road segment located along that driver's route.

According to another embodiment, the transceiver is further adapted to provide a remote server with information regarding the driver's current driving performance to enable determining whether any of the at least one road segment located along the vehicle's route might require the attention of the driver.

In accordance with another aspect there is provided a system for providing an advanced indications/warnings at a plurality of vehicles, wherein the advanced indications/warnings relate to hazardous road segments or road segments which comprise sub-segments that might have adverse effect upon vehicles' fuel consumption, which are located along the drivers' route, wherein the system comprising:

a. monitoring and locating devices, each installed at one of the plurality of vehicles, and adapted to:

(i) detect each of the respective vehicle's location;

(ii) transmit information to and receive information from a remote service provider; and (iii) provide at each of the vehicles who is about to reach a road segment which has been determined as a segment that might be a low service level segment for a driver driving the respective vehicle, an advanced indication/warning;

b. at the remote service provider server:

(i) a database comprising information on a plurality of road segments, each characterized by its location and one or more driving performance parameters associated therewith, and wherein each of the one or more driving performance parameters is provided with a pre-defined threshold value that if exceeded, would trigger generation of an indication/warning to the driver;

(ii) transceiver operative to receive information from and transmit information to the plurality of vehicles;

(iii)processor adapted to:

identify at least one road segment that is about to be reached by each of the vehicles based on their current locations, respectively;

for each of the road segments identified, retrieve values of one or more driving performance parameters associated therewith;

evaluate whether any of the retrieved values of the one or more driving performance parameters exceeds a pre-defined threshold thereof, and based on a pre-determined alarm criterion associated with the respective parameters' thresholds, determine which of the drivers is about to reach at least one road segment that is a low service level segment for that driver; and generating advanced indications/warnings to be provided to the respective drivers who are about to reach road segments which have been determined as low service level segments, respectively.

According to another embodiment, the database comprises data retrieved from a plurality of different types of sources, e.g. drivers' performance, road obstacles (such as car accidents) updates, road repairs, weather updates, etc.

In accordance with still another embodiment, the one or more driving performance parameters are parameters that reflect the driving performance of the driver. More preferably, at least one of the one or more driving performance parameters is a parameter that reflects the driver's past performance at least one driving event and/or at least one driving maneuver.

By still another aspect there is provided a computer readable medium storing a computer program for performing a set of instructions to be executed by one or more computer processors, the computer program is adapted to provide a driver of a vehicle with an advanced indication/warning, that one or more road segments located along the driver's route are potentially hazardous and/or might have an adverse effect upon his vehicle's fuel consumption, and comprising the steps of:

identify at least one road segment that the driver is about to reach based on the vehicle's current location;

retrieve values of one or more driving performance parameters associated with each of the at least one road segment identified;

evaluate whether any of the retrieved values of the one or more driving performance parameters exceeds a pre-defined threshold thereof, and based on that evaluation, determine whether the driver will be provided with an advanced indication regarding any of the at least one road segment identified; and enable providing the driver with an advanced indication/warning for any of the at least one road segment which has been so determined.

In accordance with another preferred embodiment of this aspect, the one or more driving performance parameters are parameters that reflect the driving performance of the driver. More preferably, at least one of the one or more driving performance parameters is a parameter that reflects the driver's past performance of at least one driving event and/or at least one driving maneuver.

BRIEF DESCRIPTION OF THE DRAWINGS

For a more complete understanding of the present invention, reference is made to the following detailed description taken in conjunction with the accompanying drawings wherein.

DETAILED DESCRIPTION

Figure 1:
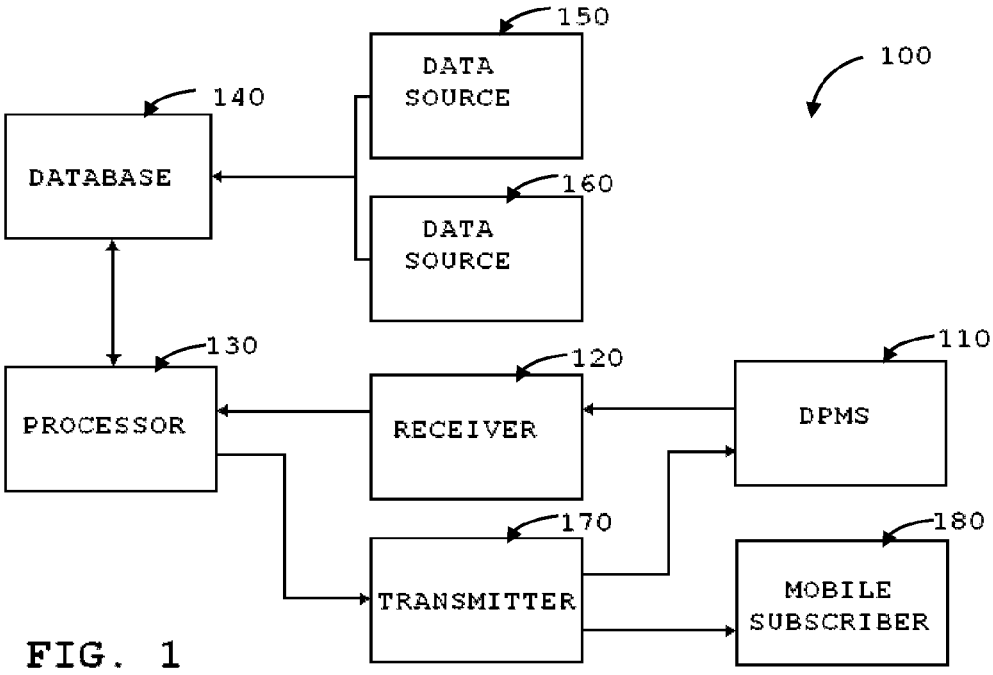
FIG. 1 illustrates a schematic overview on the system architecture.

The principles and operation of the method and system according to the present invention may be better understood with reference to the accompanying drawings and the following description that illustrate some specific non-limiting examples of preferred embodiments.

As was previously explained, there are known solutions for alerting drivers, by providing the driver with alerts that relate to known hazardous road conditions along the road which he/she is currently driving. However, these solutions are not sufficient in the everlasting battle to prevent road accidents, as none of the existing solutions take into account the performance of a specific driver. Similarly, there are solutions that provides information to a driver on how economical is his driving, but none of these solutions suggests taking into account the effect of the individual driver's performance while carrying out certain driving events and/or driving maneuvers, on the fuel consumption of the vehicle, and then provide the driver with an advanced indication even before he/she reaches a road segment along his/her route, by knowing that he/she will probably have to carry out in that road segment a driving event and/or driving maneuver that would have an adverse effect upon his vehicle's fuel consumption.

Let us now assume that there is a sharp curve along the road and when driving conditions are less than optimal, there could be drivers that might be involved in an accident if their driving pattern indicates that taking sharp turns is a weak spot in their driving performance. At the same time, such sharp turns would not present any problem even under poor driving conditions, to other drivers which their driving performance indicates that they always take in a careful way such sharp turns. The present invention enables differentiating between drivers based on their own driving performance, when determining the drivers to whom certain warning(s) should be provided. Although the driving performance according to the present invention may be performance that is defined by data retrieved from driving patterns of a plurality of drivers, still, the driving performance according to the present invention may preferably be a performance that is defined by data retrieved from previous driving sessions driven by that driver, and/or the driver's current driving performance (i.e. in the current driving session that is being monitored by monitoring means installed within the vehicle, where a driving session may be defined for example as the time that has lapsed since the time when the driver has started driving his vehicle). In order to demonstrate a determination that is taken by a combination of past and current performance, let us consider a driver who is known, based on his performance in previous driving sessions, to have a problem with the way he takes sharp turns. However, if during the current driving session it is found that the driver is approaching sharp turns at a very low speed (e.g. due to a traffic jam), the driver would not get an advanced warning in this specific case, even though that under different circumstances, e.g. while driving at a high speed, such an advanced warning would have been generated for that driver before reaching the sharp turn, due to his poor performance in the past of such a maneuver.

FIG. 1 is a schematic overview of the architecture of system 110 which comprises a Driving Performance Monitoring System (DPMS) installed within the driver's vehicle. Such a DPMS has been extensively described and exemplified in U.S. Pat. No. 7,389,178 which is hereby incorporated by reference in its entirety in order to avoid repetition of the '178 disclosure. Basically, the DPMS is a real-time monitoring system adapted to evaluate the driver's driving skills and his safety level while executing driving events which is further provided with location identification means such as a GPS. A number of sensors that are installed in the vehicle transmit a raw data stream to a processing unit, wherein the raw data stream relates to the speed of the vehicle and its acceleration. In the processing unit a unique algorithm is applied onto the raw data stream to identify specific driving events executed by the driver (sudden brakes, sharp turns, crossing lanes etc.) e.g. by comparing data retrieved from the raw data to a library of events/maneuvers and thereby identify the data which relate to such an event/maneuver from among the raw data, and derive therefrom evaluation of driving maneuvers carried out by the driver. The raw data stream and the location at which the various driving event took place are then transmitted preferably under real time or near real time conditions through cellular modem to a central processor (130) via a central receiver (120). The central processor compares the location of the driver's vehicle and the values of other driving parameters with the pre-defined threshold values of the same parameters of the relevant road segments that are located ahead of the driver and which are stored in a database (140). This database according to one embodiment of the present invention comprises data that relate to maneuvers performed by a plurality of vehicles each comprising a DPMS operative to detect driving events carried out by the vehicles' drivers and wherein the data are associated with various road segments where these driving events were carried out. In addition, the database may comprise (or linked to) other data sources (150, 160) that can provide real-time information on various road segments (e.g. the Public Works Department may update the database on any repairs/obstacles on the roads, real time accidents update etc.) Processor 130 is further adapted to retrieve values for the driving performance parameters of the driver, based upon the driver's own previous driving sessions that were monitored by his vehicle's DPMS. Processor 130 then compares the values of the driving performance parameters that characterize the driver's driving with threshold values of these parameters as they currently are for the road segments which are ahead (i.e. along the driver's route). In other words, after having established in this example which road segments are along the expected route of the driver's vehicle, the system retrieves information that relates to these segments. The difficulties that might have an impact upon the service level of each of these segments are evaluated (e.g. based on information collected from other drivers who had driven along these segments, or from any other applicable sources). This information may indicate potential safety hazards existing which caused many drivers to perform badly, and associate their poor performance with certain maneuvers that had to be taken while driving these segments. Once the maneuvers that were taken by the plurality of drivers in each segment are determined, the system can then evaluate the driver's own performance while carrying out each of these specific maneuvers. If for example, the segment comprises a sharp turn which had caused a problem to most of the drivers who drove that segment, but it is found that the specific driver is very experienced in taking such turns, then no alerting indication will be provided to the driver, even though this segment is likely to cause generation of an alerting indication to most of the other drivers.

Upon determining that one or more hazardous road segments are expected shortly, the processor provides (through transmitter 170) a warning to the driver. The warning can be provided to the driver through his mobile telephone device (180) or, according to a preferred embodiment of the invention, via a display of the vehicle's DPMS (110). As non-limiting examples, the warning can be a textual warning at the display or any other visual representation, an audio warning, or any combination thereof.

All the data gathered from the driving events carried out by the vehicles comprising DPMS is analyzed in order to create a reliable database to enable identifying hazardous road segments. Listed below are several of the parameters that may be used for road segments in the database:

A general safety grade—(e.g. in a scale of 1-10).

Reliability factor (based upon the number of driving events available for a given segment).

Number and/or type of driving events occurred at that road segment.

A safety grade per drivers' performance skill (e.g. what is the safety level at which drivers that are defined as "red drivers" (poor drivers) execute driving events at that road segment).

In addition, and if applicable, the database may comprise parameters for certain road segments that are directly related to specific drivers, such as:

Number of times a specific driver passed that road segment.

In order to have a reliable database, statistical models may be implemented to create a driver profile and rank his safety level (e.g. when several drivers that most of the times drive very safely break suddenly at the same spot, one may reliably assume that this road segment is dangerous).

Figure 2:
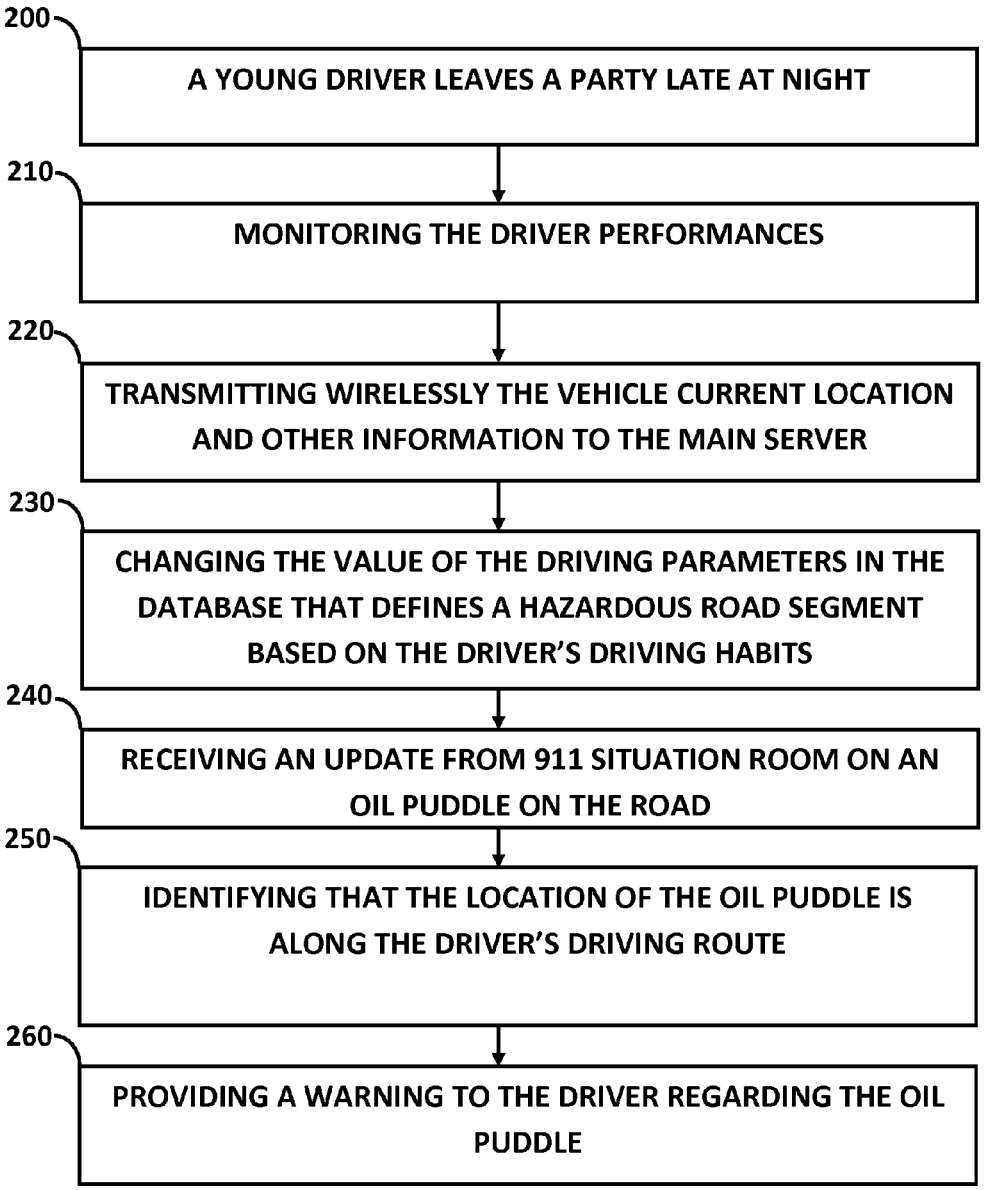
FIG. 2 presents a flow chart demonstrating an implementation of some embodiments of the present invention.

FIG. 2 is a flow chart demonstrating the implementation of some embodiments of the present invention. In this example a young driver returns home late at night after a party (step 200), the DPMS starts monitoring the driver performance as soon as he starts driving (210). The DPMS starts transmitting to the main server the vehicle's location (220) and possibly other information like the current time, speed etc. The system identifies the driver at the database, and based on the driver's history that shows that the driver has driven more recklessly late at night (especially during weekends), the system adapts the driving performance parameters to conform to the current driving conditions by reflecting these findings, so that the new values of some of these driving performance parameters exceed the pre-defined threshold values of these respective parameters for one or more road segments located along the driver's route, thereby turning the one or more road segments into hazardous road segments, and consequently, making the system to be more sensitive to potentially dangerous situations in the driver's driving route (230). Now, let us assume that the system receives an update from the 911 situation room that there is an oil puddle on the road (240) being traveled by the driver. The system identifies that the reported oil puddle is on the driver's driving route (250) and because of the substantial risk in that oil puddle, the system provides an audio advanced warning, informing the driver about the approaching hazard (260). The warning may comprise the puddle exact location, the distance from the vehicle to the oil puddle and a recommendation what is the safest option to do about it (slow down, take another route, etc.).

Let us consider another example that demonstrates the usefulness of the present invention. In this example a new road was paved, the road is in excellent condition and it passed the approval of the PWD (Public Works Department). Still, the system identifies that many drivers, even drivers that are graded as safe drivers, tend to brake suddenly in a middle of a certain curve, which of course is a very dangerous thing to do. The system also detects that this event is typically occurs in the morning time between 7:00 to 7:30. After investigating the case, it has been found that this curve is located right after a building block and within that time period, the sun shines in the eyes of every driver who takes the turn. Thus, the system is updated to allow providing all drivers that are about to reach that turn within that time period in the morning with an appropriate advanced warning so they can slow down and lower their sun shield before reaching this turn.

Figure 3:
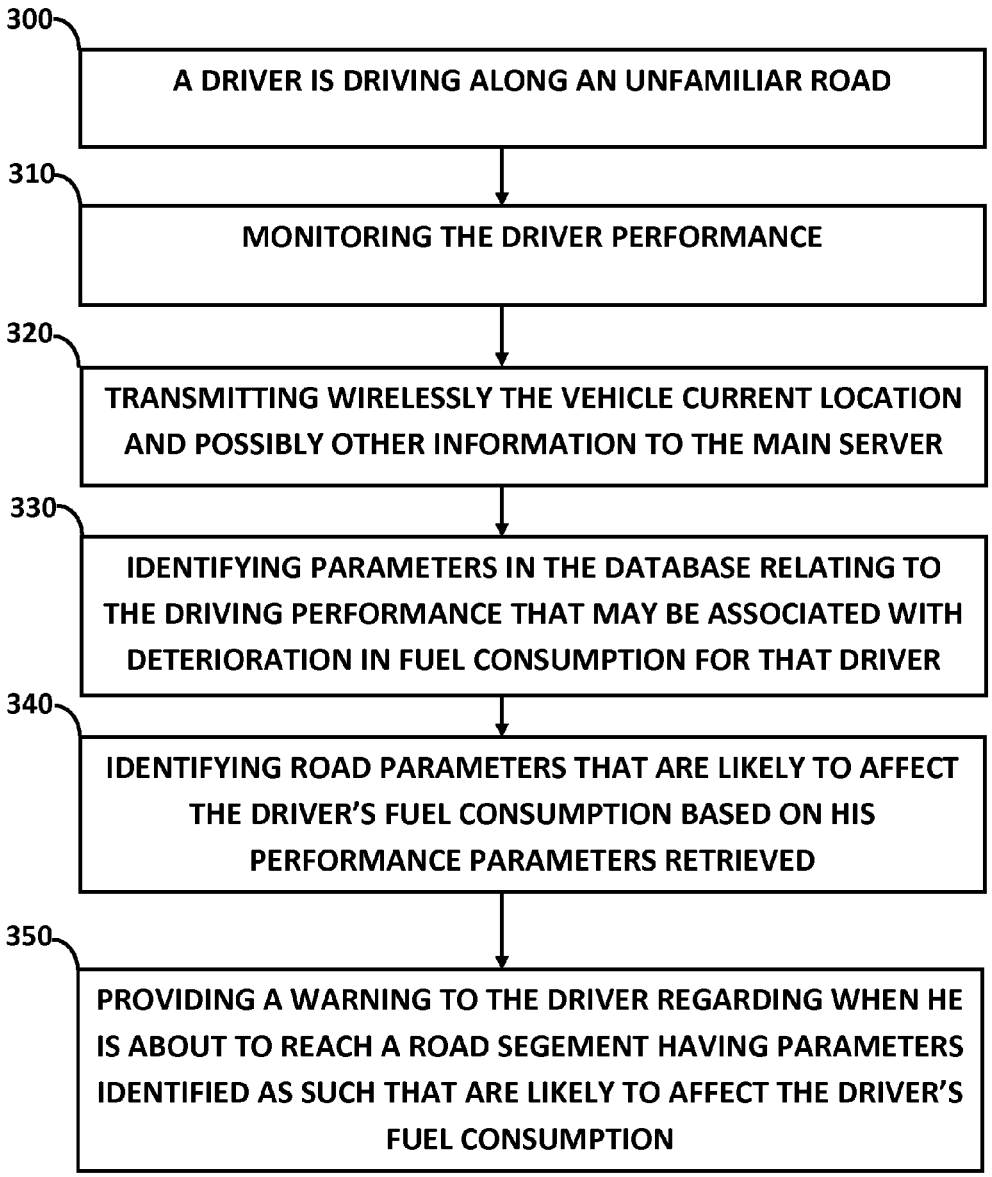
FIG. 3 presents a flow chart demonstrating an implementation of other embodiments of the present invention.

FIG. 3 is a flow chart demonstrating another implementation of some embodiments of the present invention. In this example a driver is taking a trip in his vehicle along a road which is not familiar to him (step 300), the DPMS starts monitoring the driver performance as soon as he starts driving (310), and starts transmitting the vehicle's location to the main server (320), possibly together with other information like the current time, speed etc. The system identifies the driver's entry at the database, and based on the driver's history determines that the driver who usually drives fast, tends to brake too often when driving along roads that have a considerable number of curves. Such driving leads to the driver exhibiting a poor fuel consumption management. The system then adapts the driving performance parameters to conform to the current driving conditions by reflecting these findings, so that the adapted (new) values of these parameters are now such that they exceed certain threshold values of parameters that are associated with one or more segments of road located along the driver's route. This in turn leads to defining one or more of the road segments as being road segments having low service level (e.g. which will require a special attention from the driver). By implementing the above, the system is made aware of potential deterioration in fuel consumption performance expected in the driver's driving route (330). Now, let us assume that the system identifies that the next 3 miles along the driver's route contain many curves (340), therefore it will provide an audio advanced indication to inform the driver that he is about to approach a road segment that might have an adverse effect upon his fuel consumption performance (350). The indication may comprise the exact location of the first curve, the distance from the vehicle to the first curve and a recommendation what is the preferred option to do about it (slow down, take another route, etc.).

It is to be understood that the above description only includes some embodiments of the invention and serves for its illustration. Numerous other ways of carrying out the methods provided by the present invention may be devised by a person skilled in the art without departing from the scope of the invention, and are thus encompassed by the present invention.

What is claimed is:

1. A method for providing a driver of a vehicle with an advanced indication that one or more road segments being low service level road segments are located along the driver's route, wherein said method comprising:

a) detecting the vehicle's current location and based on the detected location, identifying at least one road segment that said driver is about to reach;

b) for each of said at least one road segment identified, retrieving values of one or more driving performance parameters associated therewith;

c) evaluating whether any of the retrieved values of said one or more driving performance parameters exceeds a pre-defined threshold thereof, and based on that evaluation, determining whether any of the at least one road segment identified, might present a segment of a too low service level; and d) providing the driver with an advanced indication for any of the at least one road segment which has been determined as being a segment of a too low service level for the driver.

2. A method according to claim 1, wherein said one or more driving performance parameters are parameters that reflect driving performance of said driver.

3. A method according to claim 1, wherein at least one of said one or more driving performance parameters is a parameter that reflects said driver's past performance of at least one driving event and/or at least one driving maneuver.

4. A method according to claim 1, wherein said values of the one or more driving performance parameters associated with a respective road segment are derived by:

a) averaging performance results of a plurality of drivers who had driven that specific road segment; or b) evaluating potential difficulties associated with that specific road segment and evaluating the driver's own history performance while confronting such difficulties; or c) any combination of a) and b).

5. A method according to claim 1, wherein step c comprises:

(i) comparing values of driving performance parameters which characterize the driver's driving performance with pre-defined threshold values of corresponding driving performance parameters associated with the at least one road segment; and (ii) determining based on said comparison whether the driver should be provided with an indication regarding difficulties existing in a future road segment to be travelled.

6. A method according to claim 1, wherein said method provided further comprising:

(i) a step of monitoring the driver's performance during a period of time that precedes the provisioning of the advanced indication;

(ii) based on said monitoring step, obtaining a grade for each of a plurality of driving maneuvers taken by the driver; and (iii) deriving values for at least one of said one or more driving parameters that characterize the driver's performance, based on the step of grading each of a plurality of driving maneuvers taken by the driver.

7. A method according to claim 1, further comprising a step of monitoring the driver's current driving performance, and wherein the step of determining whether any of the at least one identified road segment might require the attention of said driver, takes into account said current driver's driving performance.

8. A device adapted to be installed in a vehicle and to provide a driver of said vehicle with an advanced indication that one or more road segments identified as low service level segments are located along the driver's route, wherein the device comprising:

I. location means operative to detect the vehicle's current location;

II. transceiver operative to communicate with a remote system and to:

i. provide said remote system with information that relates to the vehicle current location; and ii. receive values of one or more driving performance parameters associated with at least one road segment that is located along the vehicle's route;

III. processor operative to:

i. evaluate whether any of the received values of the one or more driving performance parameters exceeds a predefined threshold thereof; and ii. based on step a, determine whether any of the at least one road segment located along the vehicle route is identified as a low service level segment; and IV. indication provisioning means operative to provide the driver with an advanced indication for any of the at least one road segment which has been determined as a segment identified as a low service level segment.

9. A device according to claim 8, wherein said one or more driving performance parameters is a parameter that reflects the driver's past performance of at least one driving event and/or at least one driving maneuver.

10. A device according to claim 8, wherein the values of the one or more driving performance parameters associated with a respective road segment are derived by:

a) averaging performance results of a plurality of drivers who had driven that specific road segment; or b) evaluating potential difficulties associated with that specific road segment and comparing them with the driver's own history performance while confronting such difficulties; or c) any combination of a) and b).

11. A device according to claim 8, wherein said processor is further operative to:

(i) compare the values of driving performance parameters which characterize the driver's driving performance, with pre-defined threshold values of corresponding driving performance parameters associated with the at least one road segment; and (ii) determine based on that comparison whether the driver should be provided with an indication regarding difficulties existing in a future road segment to be travelled.

12. A device according to claim 8, further comprising monitoring means operative to monitor the driver's performance during a period of time that precedes the provisioning of the advanced indication, and wherein the processor is further operative to grade each of a plurality of driving maneuvers taken by the driver based on information received from said monitoring means and to associate values for at least one of the one or more driving parameters that characterizes the driver's own performance, based on the grades assigned for each of a plurality of driving maneuvers taken by the driver.

13. A computer readable medium storing a computer program for performing a set of instructions to be executed by one or more computer processors, the computer program is adapted to provide a driver of a vehicle with an advanced warning, indicating that one or more road segments that are low service level segments are located along the driver's route, and comprising the steps of:

identify at least one road segment that the driver is about to reach based on the vehicle's current location;

retrieve values of one or more driving performance parameters associated with each of the at least one road segment identified;

evaluate whether any of the retrieved values of the one or more driving performance parameters exceeds a predefined threshold thereof and based on that evaluation, determine whether any of the at least one road segment identified is a low service level segment; and enable providing the driver with an advanced indication for any of the at least one road segment which has been determined as a segment that might require the driver's specific attention.

14. The computer readable medium of claim 13, wherein the step of determining whether any of the at least one road segment identified is a low service level segment, is carried out with respect to a driving performance of a driver for whom it should be determined whether any of the at least one road segment identified is a low service level segment.

15. A non-transitory computer-readable storage medium storing one or more sequences of instructions which, when executed by one or more processors, cause the one or more processors to perform the steps for providing a driver of a vehicle with an advanced indication that one or more road segments being low service level road segments are located along the driver's route, wherein said steps comprise:

detecting the vehicle's current location and based on the detected location, identifying at least one road segment that said driver is about to reach;

for each of said at least one road segment identified, retrieving values of one or more driving performance parameters associated therewith;

evaluating whether any of the retrieved values of said one or more driving performance parameters exceeds a predefined threshold thereof, and based on that evaluation, determining whether any of the at least one road segment identified, might present a segment of a too low service level; and providing the driver with an advanced indication for any of the at least one road segment which has been determined as being a segment of a too low service level for the driver.

16. A non-transitory computer-readable storage medium according to claim 15, wherein said one or more driving performance parameters are parameters that reflect driving performance of said driver.

17. A non-transitory computer-readable storage medium according to claim 15, wherein at least one of said one or more driving performance parameters is a parameter that reflects said driver's past performance of at least one driving event and/or at least one driving maneuver.

18. A non-transitory computer-readable storage medium according to claim 15, wherein said values of the one or more driving performance parameters associated with a respective road segment are derived by any of: averaging performance results of a plurality of drivers who had driven that specific road segment, evaluating potential difficulties associated with that specific road segment and evaluating the driver's own history performance while confronting such difficulties, and a combination of the averaging performance results of a plurality of drivers who had driven that specific road segment and the evaluating potential difficulties associated with that specific road segment and evaluating the driver's own history performance while confronting such difficulties.

19. A non-transitory computer-readable storage medium according to claim 15, further comprising additional instructions which, when executed by the one or more processors, cause the one or more processors to perform the steps of:

comparing values of driving performance parameters which characterize the driver's driving performance with pre-defined threshold values of corresponding driving performance parameters associated with the at least one road segment; and determining based on said comparison whether the driver should be provided with an indication regarding difficulties existing in a future road segment to be travelled.

20. A non-transitory computer-readable storage medium according to claim 15, further comprising additional instructions which, when executed by the one or more processors, cause the one or more processors to perform the steps of:

monitoring the driver's performance during a period of time that precedes the provisioning of the advanced indication;

based on said monitoring step, obtaining a grade for each of a plurality of driving maneuvers taken by the driver; and deriving values for at least one of said one or more driving parameters that characterize the driver's performance, based on the step of grading each of a plurality of driving maneuvers taken by the driver.

* * * * *